US005592826A

United States Patent [19]

Sagar et al.

[11] Patent Number: 5,592,826

[45] Date of Patent: Jan. 14, 1997

[54] AIR CONDITIONING SYSTEMS WITH PURGE

[76] Inventors: Chris Sagar, 540 Carillon Pkwy., Apt. 2041, St. Petersburg, Fla. 33716; Mike Britt, 23706 Texwheeler Ave., Christmas, Fla. 32709

[21] Appl. No.: 578,367

[22] Filed: Dec. 26, 1995

[51] Int. Cl.[6] ..... F25B 43/04

[52] U.S. Cl. ..... 62/195; 62/475; 62/149

[58] Field of Search ..... 62/77, 85, 149, 62/195, 292, 475

[56] References Cited

U.S. PATENT DOCUMENTS 5,467,608 11/1995 Cording et al. ..... 62/195

5,501,082 3/1996 Tachibana et al. ..... 62/195

*Primary Examiner*—John M. Sollecito

*Attorney, Agent, or Firm*—Joseph C. Mason, Jr.; Mason & Associates, P.A.

[57] ABSTRACT

An air conditioning system includes a self-regulating flow controller having no moving parts that provides a liquid seal between a purge vessel and the evaporator barrel of a chiller. Circulating refrigerant fluid from a primary air conditioner is preheated in a preheater by hot refrigerant from the chiller prior to its entry into the purge vessel, and the preheater provides a thermal load that enables operation of the purge vessel. The purge unit discharges into a regeneration cell that removes even more refrigerant from the vapors before they are vented to atmosphere. When the regeneration cell requires recharging, it is heated to a predetermined temperature and pressure to release adsorbed refrigerant from its adsorption media, and the released refrigerant is routed back to the purge vessel and hence through the regeneration cell again prior to discharge of substantially refrigerant-free contaminants into the atmosphere.

21 Claims, 4 Drawing Sheets

AIR CONDITIONING SYSTEMS WITH PURGE

BACKGROUND OF THE INVENTION

1. Field of the Invention

This invention relates to a pressure compensation device, a preheater, and an improved regeneration cell for an air conditioning system that includes a purge vessel.

2. Description of the Prior Art

Efficient operation of chiller condensers and evaporators requires a purge device therebetween for the removal of contaminants such as acid, moisture, noncondensibles, and other debris from the refrigerant. If contaminants could be completely separated from the refrigerant, such contaminants could be purged from the system into the atmosphere without purging any refrigerant into the atmosphere. However, total separation is not possible and even the best purge devices will purge at least some refrigerant into the atmosphere. U.S. Pat. No. 5,309,729 by the present inventor discloses the most efficient purge device heretofore known; that disclosure is hereby expressly incorporated hereinto by reference.

As a purge device operates, clean, condensed refrigerant accumulates therewithin. The device is preferably mounted atop a condenser barrel of a chiller so that said clean, liquid refrigerant may flow from an upstanding overflow pipe that projects upwardly from a bottom wall of the purge device into the evaporator barrel of the chiller. However, where space limitations do not permit such mounting, the purge device must be placed at a lower level and a pump must be employed to return the clean refrigerant to the evaporator barrel.

Both of these expedients for returning clean refrigerant to the evaporator barrel have drawbacks. For example, in the condenser-evaporator system, a float is employed to open and close a valve between the overflow pipe and the evaporator barrel because the liquid level must be maintained above the opening of the overflow pipe and at a predetermined level below the coils of the purge vessel. In the pump-reliant system, a float must be employed to activate and deactivate the pump to maintain preferred liquid levels within the purge vessel.

Mechanical floats are notorious for jamming and rapid deterioration in the environment of a purge vessel. Less maintenance-intensive substitutes are available, including moisture sensors, electric eye devices, and the like, but these alternatives increase the expense of the purge vessel and are themselves subject to maintenance problems.

What is needed, then is an improved means for maintaining a desired liquid refrigerant level within a purge vessel. The improved means should not require mounting atop a condenser barrel and it should not include floats, pump or other parts that require frequent maintenance and which are subject to failure.

Separation of refrigerant and contaminants requires the highest possible differential in temperature between incoming refrigerant and outgoing refrigerant, i.e., the greater the differential, the more complete the separation. The prior art includes a refrigerant reexpansion means for lowering the low side of the temperature range, but no means are provided for increasing the high side of the temperature range. Thus, a need is extant for such means.

Moreover, the art teaches activated carbon regeneration cells for the adsorption of contaminants from refrigerant just prior to purging of the contaminants into the atmosphere. As the regeneration cells operate over time, however, the capacity of the activated carbon therein to continue adsorption drops off as the carbon becomes saturated with refrigerant. The art teaches that a vacuum should be applied to the regeneration unit to physically knock the refrigerant off the activated carbon granules when said granules have become saturated. Once the refrigerants are knocked from the granules by the shock of the vacuum, they are then routed to the chiller. If the physical shock of the vacuum is inadequate to separate the refrigerants from the granules, the granules gradually become less and less effective and subsequent purges vent more and more refrigerant into the atmosphere Instead of returning knocked-off refrigerant to the chiller, some systems burn off the refrigerant and release the combustion product to the atmosphere.

Thus, there is a need for an improved means for separating refrigerant from activated carbon granules in a regeneration cell.

However, in view of the prior art as a whole at the time the present invention was made, it was not obvious to those of ordinary skill in this art how the needed improvements could be provided.

SUMMARY OF THE INVENTION

The present invention includes a device for returning decontaminated refrigerant to an evaporator barrel in the absence of mechanical floats, electric eyes, or other such devices. It includes no moving parts and is therefore essentially maintenance free, virtually immune to failure, and very economical to manufacture.

The invention further includes a preheater means for increasing the temperature of refrigerant before it enters a purge vessel, to thereby increase the efficiency of the purge vessel, and an improved means for separating contaminants from activated carbon granules in a regeneration cell. The improved system further includes the step of venting the contaminates to atmosphere only if the media of the regeneration cell is unsaturated, and if the media has become saturated, routing said contaminants through the preheater and the purge vessel after the media has been regenerated.

Moreover, the novel system employs heat as the means for regenerating the adsorption media, in lieu of a vacuum.

In a preferred embodiment, the novel self-regulating device for controlling refrigerant flow from the purge vessel takes the form of a copper cylinder disposed so that its longitudinal axis of symmetry is positioned in a vertical plane when it is attached to the purge vessel. The cylinder is insulated against heat transfer and is capped at its top and bottom ends. An inlet tube that extends from the purge vessel is in fluid communication with the bottom wall of the cylinder and a discharge tube that extends to an evaporator barrel is in fluid communication with the top wall of the cylinder, i.e., the cylinder is positioned between the outlet of the purge vessel and the inlet of the evaporator barrel. The liquid refrigerant in the cylindrical device is exposed to the pressure of the chiller evaporator through the discharge tubing and boils off in response thereto. The vaporization cools off the liquid refrigerant remaining in the device, thereby slowing down the evaporation rate. A large influx of warm liquid refrigerant causes the evaporation rate to increase. Thus, the device is a servomechanism, i.e., the level of liquid refrigerant within the device is self-regulating and the liquid seal between the purge device and the evaporator barrel is maintained as the flow rate of refrigerant thereinto changes over time. Importantly, the device includes no moving parts and is thus substantially maintenance free.

A novel preheater heats the refrigerant prior to its entry into the purge vessel, thereby enhancing the efficiency of said vessel. More particularly, the preheater superheats the refrigerant entering the evaporator coil of the purge vessel, thereby increasing the difference between the specific density of the refrigerant and the specific density of the contaminants to thereby facilitate their separation.

In the regeneration cell of this invention, the vacuum separation of the prior art is eschewed in favor of heating the activated carbon to release the adsorbed contaminants therefrom.

Significantly, means are provided to periodically test the adsorption media for evidence of saturation. If saturation is detected, the heater is activated and the refrigerant thereby released is routed to the preheater and hence to the purge device and the regeneration cell, rather than burning off such refrigerant or venting it to atmosphere.

These three improvements cooperate to provide an air conditioning system of greater efficiency and a purge system that vents a reduced amount of refrigerant to the atmosphere.

A first important object of the invention is to provide improved means for maintaining a liquid seal between a purge device and an evaporated barrel of a chiller.

Another important object is to enhance purge device operation by preheating refrigerant fluid prior to its entry thereinto.

Still another important object is to provide an improved means for regenerating activated carbon regeneration cells.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
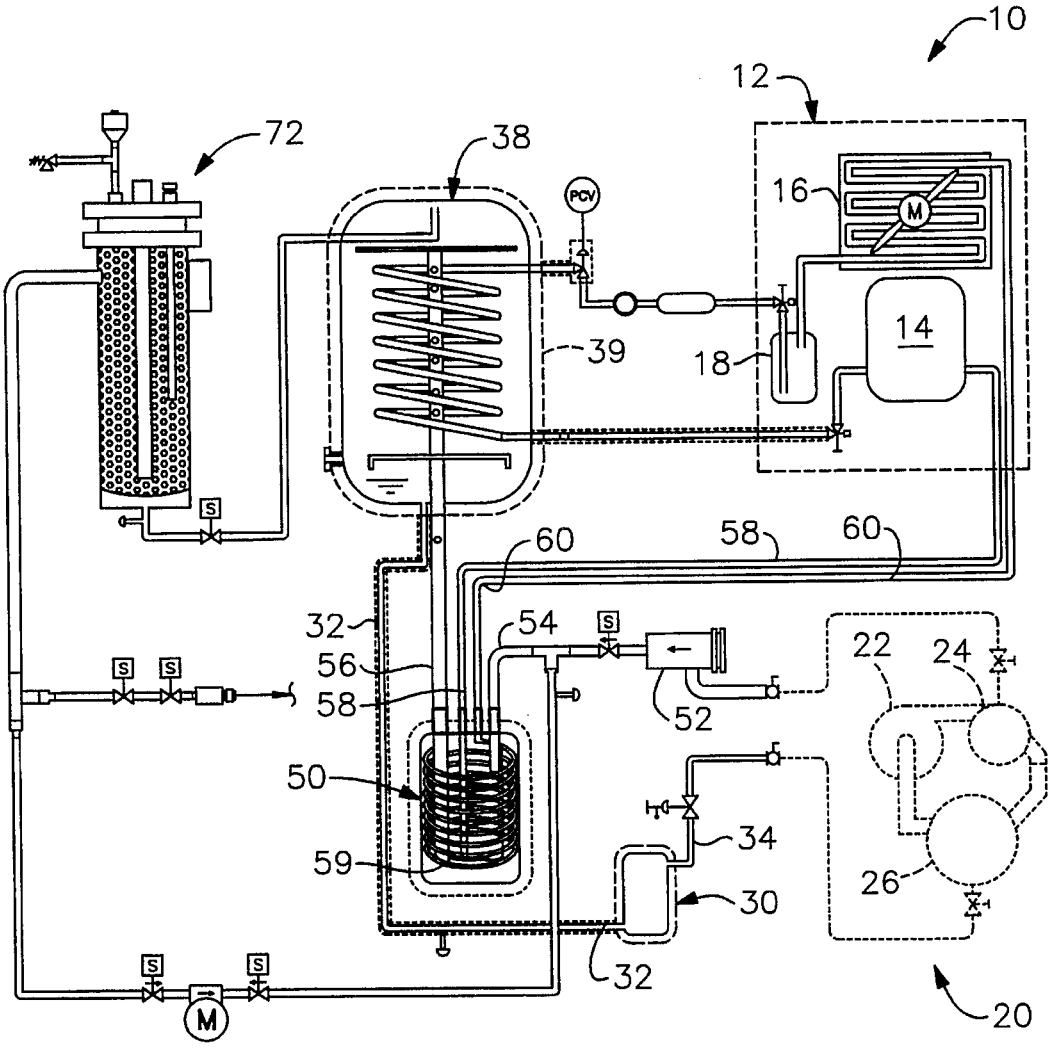
FIG. 1 is a diagram of the improved air conditioning system of this invention as a whole.

Referring now to FIG. 1, it will there be seen that an exemplary embodiment of the invention is denoted as a whole by the reference numeral 10.

Novel system 10 includes a conventional air conditioning system 12 having a compressor 14, a condenser coil 16, and a receiver 18. The efficiency of conventional system 12 is improved by a low temperature, high pressure chiller 20 that includes a compressor 22, a condenser 24 and an evaporator 26.

The static pressure compensator or controller of this invention is denoted 30 in FIG. 1; the novel preheater is denoted 50, and the novel regeneration cell is denoted 72.

Note that static pressure controller 30 is connected between chiller condenser 24 and chiller evaporator 26; more particularly, its input 32 is in fluid communication with said condenser 24 (through purge vessel 38) and its output or discharge pipe 34 is in fluid communication with said evaporator 26.

Figure 2:
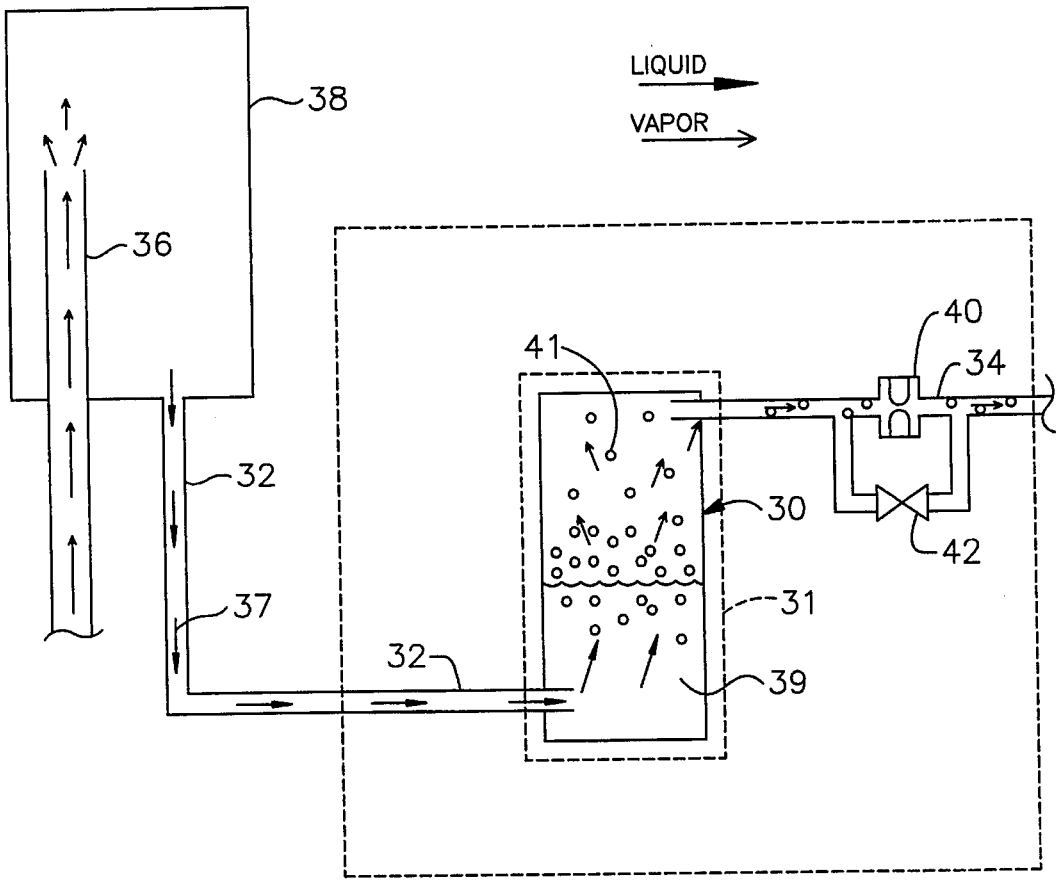
FIG. 2 is a diagram of the self-regulating static flow controller of this invention.

FIG. 2 depicts static pressure compensator 30 in greater detail; note that it is wrapped in a layer of thermal insulation 31. In a preferred embodiment, compensator 30 is a cylindrical copper vessel. Relatively warm refrigerant vapor enters purge vessel 38 through inlet pipe 36 and refrigerant liquid 37 exits said purge vessel 38 through outlet pipe 32, said pipe being inlet pipe 32 for compensator 30. Since chiller condenser 24 is at a high pressure relative to the pressure of chiller evaporator 26, refrigerant vapor, denoted 41, is boiled off in compensator 30.

Downstream orifice 40 meters the flow of vapor 41 as it returns to chiller evaporator 26; the rate of flow through the orifice is a function of orifice size and the pressure differential across it. Bypass solenoid valve 42 is normally open but is energized, i.e., held closed when the chiller is operating. Thus, it opens automatically when the chiller is not operating.

This novel arrangement of parts includes no mechanical floats or other moving parts. Significantly, it is self-regulating. Specifically, an increased rate of flow of warm refrigerant flow into vessel 30 through inlet pipe 32 causes the evaporation rate within the vessel to increase. Conversely, a decreased rate of flow into the vessel decreases the mass flow rate due to the subcooling effect of the evaporation process; note that thermal insulation 31 serves to modulate rapid changes in thermal effect. In other words, the evaporation rate increases with an increasing rate of introduction of condensed refrigerant into the static flow controller and the rate decreases within a decreasing rate of introduction of condensed refrigerant thereinto so that a liquid seal is maintained at all times, i.e., the evaporation rate is directly proportional to the rate of refrigerant flow into the controller.

More particularly, if warm liquid refrigerant enters vessel 30 at inlet pipe 32 at a rate that exceeds the evaporation rate within the vessel, said vessel simply fills up and the liquid refrigerant overflows into discharge pipe 34 and hence flows through orifice 40. Under such conditions, the full differential pressure between condenser 24 and evaporator 26 is applied to said orifice, and the liquid refrigerant flashes into vapor. Such flashing substantially increases the volumetric rate of flow and the refrigerant level within vessel 30 thus falls rapidly until the level thereof is below inlet pipe 32. The refrigerant level in purge vessel 38 therefore drops rapidly, but such level will not drop below the liquid seal. The drop of the refrigerant fluid level in purge vessel 38 introduces a warm vapor bubble from the purge vessel into compensator 30; the presence of such bubble causes the liquid level within compensator 30 to drop. The vapor bubble rises to the top of compensator 30 and flows to orifice 40 through discharge pipe 34. This allows re-establishment within the now warmer compensator 30 of the liquid-to-vapor conversion process. Thus, the static flow controller is self-regulating for various flow rates while maintaining the greatest pressure drop (across the chiller condenser and chiller evaporator) across compensator 30 instead of across purge vessel 38.

Note the liquid seal formed between the chiller condenser and chiller evaporator when the refrigerant level is normal within compensator 30.

Figure 3:
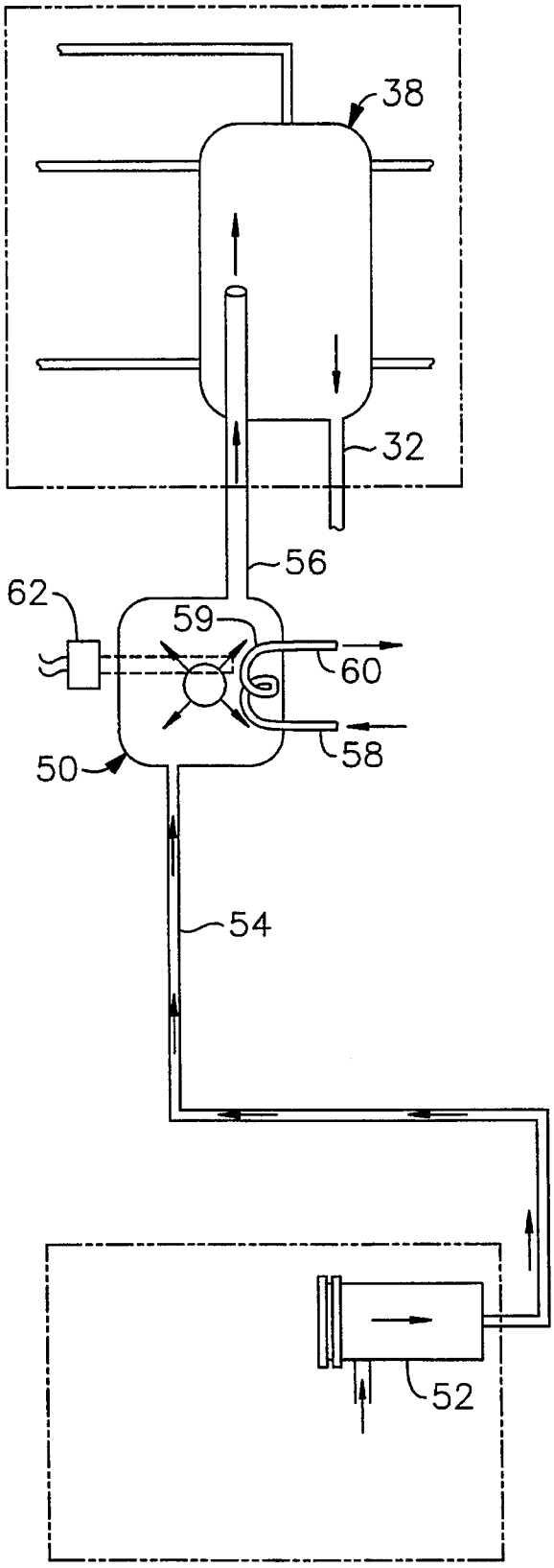
FIG. 3 is a diagram of the novel preheater.

Novel preheater 50 is depicted in increased detail in FIG. 3. Low temperature vapor from the chiller condenser 24 is filtered and dried by filter/drier 52 which is positioned upstream from the preheater. Alternatively, the source of the refrigerant vapor could be the top of a storage tank, the purge tap point of a recovery vessel or, for off-line chillers, the highest point of the chiller refrigerant system. Conduit 54 delivers the filtered and dried vapor to the preheater, and conduit 56, which is insulated and of minimum length to limit heat loss, delivers the superheated vapors from the preheater to purge vessel 38. The path of travel followed by the vapor as it passes through the preheater is referred to herein as the primary circuit. In a first embodiment, the vapors are heated by heat transfer from a secondary circuit, preferably in the form of a coil 59 to increase dwell time, that enters preheater 50 at inlet 58 and which exits therefrom at outlet 60. Secondary coil 59 is also depicted in FIG. 1. The primary circuit low temperature vapor 54 is thus in prolonged contact with the hot refrigerant 58 in the secondary circuit, thereby ensuring the heating of the former and the advantageous cooling of the latter.

As best understood in connection with FIG. 1, the hot refrigerant in coil 59 may be provided by compressor 14. However, any alternative means for heating vapor 54 may also be employed. For example, as indicated in FIG. 3, a gas-immersion type electric heating element 62 or suitable alternative device could be employed to raise the temperature of the primary circuit. The surface temperature and maximum operating temperature of the heating element are controlled by built-in thermostatic switches or variable power controllers. Excess surface temperatures are avoided to inhibit break-down of the chemical bonds of the refrigerant.

Note in FIG. 1 that a layer of thermal insulation 39 is provided about purge vessel 38. Note further that a pressure-rated heat exchanger could be employed instead of the illustrated preheater.

Heretofore, thermal purge units could not be used on refrigerant storage vessels, off-line chillers, and recovery vessels, because such units contain no thermal load and may operate at a wide variety of static temperatures and pressures. The novel preheater enables the use of purge units in connection with such devices because it provides the necessary thermal load and differential pressure and temperature that allows functioning of the purge unit DX (direct expansion) refrigeration system.

Figure 4:
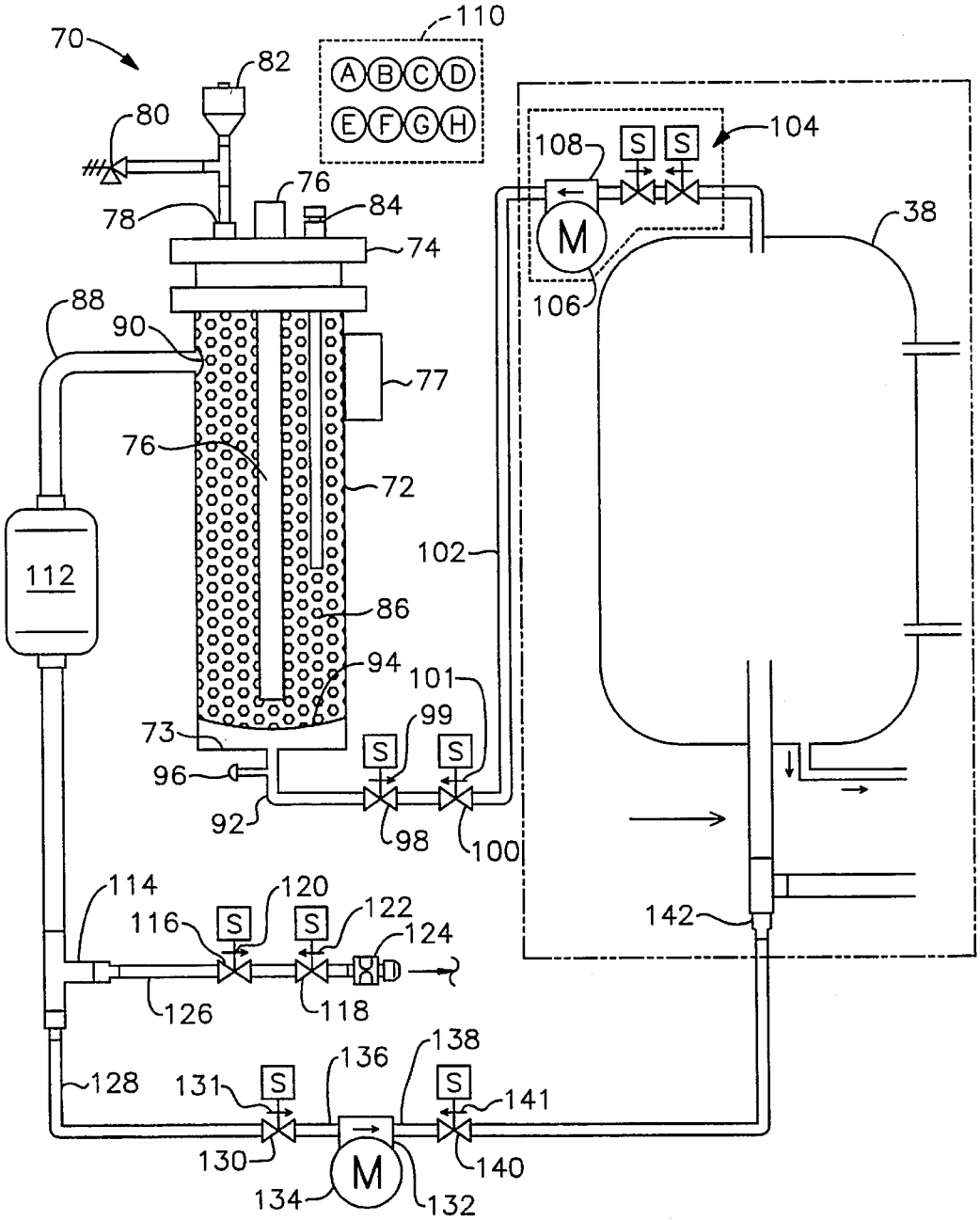
FIG. 4 is a diagram of the novel refrigerant regeneration recycler.

The refrigerant regeneration recycler of this invention is denoted as a whole by the reference numeral 70 in FIG. 4. It has utility in removing the small amounts of refrigerant that may remain in the output of the purge vessel, i.e., in the noncondensibles discharged by such purge vessel. The refrigerant is adsorbed by activated carbon in a known way so that only a trace amount of refrigerant is emitted into the atmosphere when the noncondensibles are released to the atmosphere.

Cylindrical housing or regeneration cell 72 is capped by a releasably mounted flat closure means 74. Three screw-threaded gas tight openings are formed in closure means 74 for respectively receiving 1) a low watt-density, gas-tight, electric "immersion" regeneration cell heater 76, (or a heat tape that is wrapped around the cell, or a shell-in-tube or other suitable heat exchanger) 2) tubing 78 in fluid communication with pressure relief valve 80 and pressure transmitter 82, and 3) a gas-tight thermowell 84.

A direct-contact high temperature limit switch 77 is mounted to the side of housing 72; it disconnects cell heater 76 if a predetermined temperature threshold is exceeded.

Regeneration cell 72 is filled with 70% minimum CC14 activity-rated activated carbon adsorbent media 86. Outlet 88, having an adsorbent media retention screen 90 therein, is fitted to cylinder 72 near the top thereof as depicted. Inlet conduit 92 delivers noncondensibles from purge vessel 38 into cell 72 at the bottom thereof as shown; said noncondensibles are constrained to flow first through an adsorbent media retention screen 94 that is positioned just above said inlet. Note that screen 94 is spaced slightly above bottom wall 73 of cylinder 72 to ensure even distribution of the noncondensibles across said screen 94.

Inlet conduit 92 carries an inlet pressure test fitting 96 and two normally closed solenoid valves 98, 100, that are parallel-wired and disposed in back-to-back relation to one another. Valves 98, 100 are connected so that their respective high-to-low pressure flow indicators 99, 101, point toward one another as indicated; this arrangement ensures positive seating in both pressure and vacuum service conditions.

Atmospheric discharge tubing 102 provides fluid communication between regeneration cell 72 and purge vessel 38. Additional solenoid valves, collectively denoted 104 (near the top of purge vessel 38), a pump/motor, collectively denoted 106, and a flow restrictor 108 or other conventional devices are disposed between purge vessel 38 and discharge tubing 102. Accordingly, solenoid valves 98, 100, 104, pump/motor 106, flow restrictor 108, and other such devices are powered and controlled primarily from purge unit 38 and secondarily through an override and monitor control system in control panel 110 of the refrigerant regeneration recycler unit 72.

In-line filter drier 112, carried by outlet conduit 88 (left side of FIG. 4), prevents adsorbent media fines 86 from reaching any of the downstream components of the system. Tee fitting 114 is connected to outlet conduit 88 downstream of filter drier 112. One leg of the tee is connected to conduit or vent line 126 which carries a pair of normally-closed, simultaneously operating, parallel-wired, back-to-back solenoids 116, 118. They are arranged so that their respective high-to-low pressure flow indicators 120, 122, respectively, point toward one another, just like the arrangement of solenoids 98, 100, to ensure positive seating in both pressure and vacuum service conditions.

A static flow restrictor or orifice 124 is disposed in vent line 126 downstream of said solenoids 120, 122; gaseous fluid flowing through orifice 124 is vented to the atmosphere.

Line 128 extends from the second branch of tee fitting 114; said line 128 carries another normally closed solenoid valve 130 and vacuum pump 132 having motor 134. The inlet of pump 132 is denoted 136 and the outlet thereof is denoted 138. Pump outlet 138 is in fluid communication with normally closed solenoid valve 140; said valve 140 is parallel-wired to inlet solenoid valve 130 and vacuum pump 132. Note that the flow indicators 131 and 141 of valves 130 and 140, respectively, point toward one another toward pump 132. Note further, that chiller condenser inlet port 142 is downstream of pump outlet 138 and solenoid valve 140.

The operation of system 72 will now be set forth. It should be understood from the outset that the system performs a capture cycle and a regeneration cycle in continuing sequence.

When purge vessel 38 begins its discharge cycle, i.e., when it begins to purge noncondensibles into the atmosphere, valves 104 and pump 106, and any other pumps or valves that may be provided between said vessel 38 and solenoid valve 100 in alternative embodiments of the depicted apparatus, are energized. Thus, instead of being purged to the atmosphere, the purported noncondensibles are routed by conduit 102 into regeneration cell 72 for further treatment. Pressure transmitter 82 monitors the flow of the noncondensibles into cell 72, and de-energizes (closes) valves 104 and pump 106, and other such valves and pumps, if any, when the purge cycle ends or when the pressure within cell 72 reaches a predetermined threshold such as 10 pounds per square inch, whichever first occurs. Simultaneously, valves 116 and 118 open, allowing a slow discharge of refrigerant-cleansed noncondensibles to enter the atmosphere through flow restrictor 124. The discharge continues until the purge unit 38 stops discharging its contents into regeneration cell 72 and the pressure inside cell 72 drops to 1 psig as measured by pressure transmitter 82. Valves 98, 100 and 116,118 then close, thereby preventing further discharge into cell 72 and further discharge into the atmosphere, respectively. This discharge and capture cycle is repeated several times without regenerating cell 72 because the activated carbon granules 86 therein can adsorb a large amount of refrigerant without regeneration.

However, after an empirically-determined number of cycles, the granule surfaces will be fully or substantially occupied by refrigerant, i.e., the absorbent media will have reached a refrigerant saturation point, and regeneration will be required. Cell heater 76 is energized to accomplish such regeneration; control means 110 overrides valves 104, motor and pump 106, and other such devices as may be provided, to prevent discharge of noncondensibles from purge vessel 38 during such heating of regeneration cell 72, i.e., regeneration cell 72 is isolated from the purge vessel. As the temperature in the cell rises, its internal pressure is monitored by pressure sensor 82 and its internal temperature is monitored by temperature sensor 84; nonsaturation of cell media 86 is indicated if a predetermined temperature is reached before a predetermined pressure is reached. In that event, control means 110 de-energizes heater 77 and re-enables valves 104, motor and pump 106, and related parts, if any, to terminate the isolation of the regeneration cell from the purge vessel. Control means 110 then allows the completion of a few more discharge and capture cycles before initiating another regeneration cycle.

However, if pressure sensor 82 and temperature sensor 84 respectively sense that regeneration cell 72 has reached the predetermined pressure and temperature, control means 110 maintains the isolation of the regenerator cell and continues activation of heater 76, thereby allowing the temperature and pressure within the cell to rise to a higher predetermined pressure and temperature. A timer means, provided as a part of control means 110, is then activated and cell heater 76 is cycled on and off to maintain said higher predetermined pressure and temperature for a predetermined interval of time. The conditions within the cell cause the adsorbed refrigerant to release from the carbon granules, i.e., the heat within the cell causes the release of the refrigerant, not a vacuum shock as in earlier devices.

The timer means is deactivated after a predetermined time, to terminate the on and off cycling, and regeneration vacuum pump 132 and solenoid valves 130 and 140 are energized. This enables the warm, pressurized refrigerant vapors in regeneration cell 72, which have been released from the absorbent media 86, to flow through the preheater and into purge tank 38 through vapor inlet 142. The purge tank then performs its function, i.e., said warm vapors are condensed, separated from any remaining noncondensibles, and returned to the chiller.

The escape of the warm, pressurized vapors from regeneration cell 72 continues until pressure sensor 82 detects a predetermined level of vacuum. When that predetermined level of vacuum has been detected, regeneration cell heater 76, regeneration vacuum pump 132, and solenoid valves 130, 140 are deenergized and discharge valves 104 of purge unit 38 and pump 106 are reenergized, i.e., the isolation of the regeneration cell from the purge vessel is ended. Control system 110 then begins counting the number of discharge and capture cycles and initiates the above-described regeneration cycle after a predetermined number of said cycles has been counted.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been disclosed,

What is claimed is:

1. An air conditioning system having refrigerant circulating therethrough, comprising:

a primary compressor and a primary condenser;

a purge vessel for separating noncondensibles and condensibles from said refrigerant;

a refrigerant preheater disposed in fluid communication between an outlet of said primary compressor and an inlet of said purge vessel, said refrigerant preheater providing a thermal load enabling operation of said purge vessel in said system;

a chiller including a compressor, a condenser, and an evaporator;

a refrigerant regeneration recycling means for separating contaminants from said refrigerant;

said refrigerant regeneration recycling means having an inlet in fluid communication with an outlet of said purge vessel and having an outlet in selective fluid communication with a vent to atmosphere and an inlet of said preheater; and a static flow controller having an inlet in fluid communication with condensed refrigerant collected in a bottom of said purge vessel and having an outlet in fluid communication with said chiller evaporator;

said static flow controller being at least partially filled with condensed refrigerant to provide a liquid seal between said chiller evaporator and condenser, said condensed refrigerant evaporating within said static flow controller at a rate that is proportional to the rate of input thereinto of condensed refrigerant from said purge vessel.

2. The system of claim 1, wherein said static flow controller is insulated to modulate temperatures changes within it.

3. The system of claim 1, wherein said purge vessel is insulated to modulate temperature changes within it.

4. The system of claim 1, further comprising:

a metering orifice disposed downstream of said outlet of said static flow controller;

a-bypass valve disposed downstream of said static flow controller in bypass relation to said metering orifice;

said metering orifice being open and said bypass valve being closed when said chiller is operating; and said metering orifice being closed and said bypass valve being open when said chiller is not operating.

5. The system of claim 1, wherein said refrigerant preheater further comprises:

a preheater inlet for receiving low temperature refrigerant from a suitable source;

a preheater outlet for delivering superheated vapors to said purge vessel;

a primary circuit, suitable for having refrigerant to be preheated flowing therethrough, being disposed in fluid communicating relation between said preheater inlet and said preheater outlet; and a source of heat disposed in the heat transfer relation to said primary circuit.

6. The system of claim 5, wherein said source of heat is an electric heater.

7. The system of claim 5, wherein said source of heat is a secondary circuit through which refrigerant flows, said refrigerant in said secondary circuit having a higher temperature than refrigerant in said primary circuit so that heat is transferred from said secondary circuit to said primary circuit.

8. The system of claim 5, wherein said primary circuit is in the form of a coil to increase the dwell time of refrigerant within said primary circuit, thereby increasing the amount of time for heat to transfer from said secondary circuit to said primary circuit, and wherein said secondary circuit is a coil disposed between the condenser and the evaporator of said chiller.

9. The system of claim 1, wherein said refrigerant regeneration recycling means further comprises a regeneration cell having a refrigerant-adsorbing media contained therewithin to separate said refrigerant from noncondensibles so that only a trace amount of refrigerant is emitted into the atmosphere when the noncondensibles are released to the atmosphere;

whereby refrigerant-containing vapor purged from said purge vessel is constrained to flow through said regeneration cell prior to entering the atmosphere.

10. The system of claim 9, further comprising:

a heater disposed within said regeneration cell for heating said refrigerant-adsorbing media;

a temperature sensor for detecting temperature levels within said regeneration cell;

a pressure sensor for detecting pressure levels within said regeneration cell;

control means for counting a predetermined number of cycles of said purge vessel and hence the number of times vapor from said purge vessel has passed through said regeneration cell and for isolating said regeneration cell from said purge vessel after said predetermined number of cycles has been counted;

control means for activating said heater means when said predetermined number of cycles has been counted; and means for shutting off said heater means and for ending the isolation of said regeneration cell from said purge vessel if a first predetermined temperature is not reached within said regeneration cell prior to reaching a first predetermined pressure, said failure to reach said first predetermined temperature prior to reaching said first predetermined pressure indicating that the adsorbent media in said regeneration cell is not in need of regeneration.

11. The system of claim 10, further comprising:

means for maintaining the isolation of said regeneration cell from said purge vessel if said temperature sensor detects that said first predetermined threshold temperature has been reached when said first predetermined pressure is reached, thereby indicating saturation of said adsorption media and a need for regeneration thereof;

control means for raising the temperature within said regeneration cell to a second predetermined temperature higher than said first predetermined temperature and for maintaining said higher temperature for a predetermined interval of time;

control means for routing refrigerant-containing vapors released by the adsorbent media of said regeneration cell, in response to said heating to said second predetermined temperature, to said preheater and hence to said purge vessel after the lapse of said predetermined interval of time.

12. The system of claim 11, further comprising control means for activating a vacuum pump and motor, disposed between an outlet of said regeneration cell and an inlet of said purge vessel, to cause refrigerant released from said adsorbent media to flow from said regeneration cell to said purge vessel, said control means including means for shutting off said vacuum pump and motor when the pressure within said regeneration cell has dropped to a predetermined low level.

13. The system of claim 12, further comprising control means for terminating the isolation of said regeneration cell from said purge vessel when said pressure within said regeneration cell has dropped to said predetermined low level.

14. The system of claim 10, further comprising an upper adsorbent media retention screen fitted to said regeneration cell near a top end thereof.

15. The system of claim 10, further comprising a lower adsorbent media retention screen positioned in predetermined spaced relation above an inlet to said regeneration cell to promote even distribution of noncondensibles across said lower adsorbent media retention screen.

16. The system of claim 10, further comprising a pair of normally closed valves disposed in back-to-back relation to one another between an inlet of said regeneration cell and an outlet of said purge vessel so that high-to-low pressure flows of said valves are directed toward one another, said back-to-back positioning of said valves promoting positive seating in both pressure and vacuum operating conditions of said regeneration cell.

17. The system of claim 10, further comprising a pair of valves disposed in back-to-back relation to one another between said regeneration cell and said vent to atmosphere to promote positive seating in both pressure and vacuum operating conditions.

18. The system of claim 10, further comprising a pair of valves disposed in back-to-back relation to one another between an outlet of said regeneration cell and an inlet to said preheater to promote positive seating in both pressure and vacuum operating conditions.

19. The system of claim 10, further comprising a filter-drier disposed between said regeneration cell and said vent to atmosphere and between said regeneration cell and said purge vessel to prevent introduction of adsorbent media fines into said valves and into the atmosphere and to prevent introduction of adsorbent media fines into said purge vessel.

20. The system of claim 10, further comprising a static flow restrictor disposed between said outlet of said regeneration cell and said vent to atmosphere.

21. The system of claim 12, wherein said vacuum pump and motor are disposed between said back-to-back valves disposed between said outlet of said regeneration cell and said inlet of said preheater.

* * * * *